United States Patent [19]

Matsuda et al.

[11] Patent Number: 4,510,771

[45] Date of Patent: Apr. 16, 1985

[54] CRYOSTAT WITH REFRIGERATING MACHINE

[75] Inventors: Toshiharu Matsuda, Kudamatsu; Minoru Imamura; Norihide Saho, both of Yamaguchi, all of Japan

[73] Assignee: Hitachi, Ltd., Tokyo, Japan

[21] Appl. No.: 520,515

[22] Filed: Aug. 4, 1983

[30] Foreign Application Priority Data

Aug. 16, 1982 [JP] Japan ..... 57-141113

[51] Int. Cl.[3] ..... F25B 19/00

[52] U.S. Cl. ..... 62/514 R

[58] Field of Search ..... 62/6, 45, 514 R

[56] References Cited

U.S. PATENT DOCUMENTS

| | | | |
|---|---|---|---|
| 3,119,238 | 1/1964 | Chamberlain et al. | 62/45 |
| 3,195,620 | 7/1965 | Steinhardt, Jr. | 62/45 |
| 3,358,472 | 12/1967 | Klipping | 62/45 |
| 3,364,687 | 1/1968 | Kolm | 62/45 |
| 4,277,949 | 7/1981 | Longsworth | 62/514 R |
| 4,335,579 | 6/1982 | Sugimoto | 62/6 |

*Primary Examiner*—Ronald C. Capossela

*Attorney, Agent, or Firm*—Antonelli, Terry & Wands

[57] ABSTRACT

In a cryostat composed of a first liquefied gas reservoir containing therein a first liquefied gas, a second liquefied gas reservoir containing therein a second liquefied gas, which has a boiling point higher than that of the first liquefied gas, the second liquefied gas reservoir being provided around the first liquefied reservoir in order to reduce the heat leak into the first liquefied gas reservoir, and an outer wall surrounding the second liquefied gas reservoir through a vacuum space, a refrigerating machine is arranged in the space within the outer wall and cools the second liquefied gas in the second and first liquefied gas reservoirs and the first liquefied gas whereby the cryostat may be used continuously for a long period of time without periodically supplying the second and third gases.

9 Claims, 5 Drawing Figures

CRYOSTAT WITH REFRIGERATING MACHINE

BACKGROUND OF THE INVENTION

The present invention relates to a cryostat and, more particularly, to a cryostat with a refrigerating machine for cooling a superconductive magnet.

A typical prior art cryostat for cooling a superconductive magnet is shown in FIG. 1.

FIG. 1 shows an example of a cryostat of a nuclear magnetic resonance device which is generally referred to as "NMR" and in which a superconductive magnet is used. In FIG. 1, reference numeral 1 denotes a cryostat body; 2, a cylindrical inner wall; 3, a superconductive magnet; 4, a first liquefied gas reservoir (which will be hereinafter referred to as a liquefied helium resorvoir) containing a first liquefied gas (which will be hereinafter referred to as a liquefied helium) for cooling the superconductive magnet 3; 5, a second liquefied gas reservoir (which will be hereinafter referred to as a liquefied nitrogen reservoir) provided around the liquefied helium reservoir 4 in order to prevent a heat leak thereinto and containing a second liquefied gas (hereinafter referred to as a liquefied nitrogen) having a boiling point higher than that of the first liquefied gas; 6, a liquefied helium supply passage; 7, a liquefied nitrogen shield tube; 8, a liquefied helium supply passage cover; 9 a liquefied nitrogen supply passage; and 10, a liquefied nitrogen supply passage cover. A space surrounded by the cryostat body 1, the liquefied helium reservoir 4, the liquefied nitrogen reservoir 5 and the cylindrical inner wall 2 is kept under a vacuum condition in order to reduce the heat leak from the outside. FIG. 2 illustrates a supply manner of liquefied helium and nitrogen in the conventional cryostat, in which reference numeral 11 denotes a liquefied helium container; 12, a liquefied helium supply pipe; 13, a liquefied nitrogen container; and 14, a liquefied nitrogen supply pipe.

The operation of the thus constructed conventional cryostat will be described. First of all, liquefied nitrogen is fully supplied from the liquefied nitrogen container 13 through the liquefied nitrogen supply pipe 14 and the liquefied nitrogen supply passage 9 to the liquefied nitrogen reservoir 5. Subsequently, liquefied helium is fully supplied from the liquefied helium container 11 through the liquefied helium supply pipe 12 and the liquefied helium supply passage 6 to the liquefied helium reservoir 4.

When the liquefied helium is supplied to the liquefied helium reservoir 4, the magnet in the reservoir is held under a superconductive state and will operate as a superconductive magnet 3.

When the superconductive magnet 3 operates, a test piece (not shown) set inside of the cylindrical inner wall 2 is subjected to a magnetic field, enabling to conduct a living body inspection through a nuclear magnetic resonance.

However, according to such a conventional cryostat, there have been raised the following disadvantages. Namely, in an NMR system for a whole human body, which is used for the purpose of a cancer inspection, since the superconductive magnet 3 becomes large in physical size, the liquefied helium reservoir 4 containing it and the liquefied nitrogen reservoir 5 for performing the thermal shield are correspondingly large in size. Therefore, the heat leak into the liquefied nitrogen reservoir 5 and the liquefied helium reservoir 4 would be remarkable. Thus, since evaporation of the liquefied nitrogen and helium is accelerated, the supply amount of the liquefied nitrogen and helium must be increased. The liquefied nitrogen and liquefied helium must be dealt with by a skilled artisan. In addition, since the NMR is installed in a hospital, such an artisan who would not be required in the hospital must be employed only for the purpose of supply of liquefied nitrogen and helium. Moreover, an operation for interchanging liquefied nitrogen containers 13 and liquefied helium containiners 11 is periodically needed inconveniently.

SUMMARY OF THE INVENTION

An object of the invention is to provide a cryostat with a refrigerating machine for an extremely low temperature in which a periodical operation of supplying liquefied nitrogen and helium is not necessary.

The above noted defects inherent in the prior art cryostat are overcome according to the invention by providing a cryostat characterized in that a refrigerating machine composed of a heat exchanger and an expansion device is provided in a space enclosed by an outer wall of the cryostat and a liquefied nitrogen in a liquefied nitrogen reservoir and a liquefied helium in a liquefied helium reservoir are cooled by the refrigerating machine.

BRIEF DESCRIPTION OF THE INVENTION

DETAILED DESCRIPTION OF THE PREFERRED EMBODIMENTS

Figure 1:
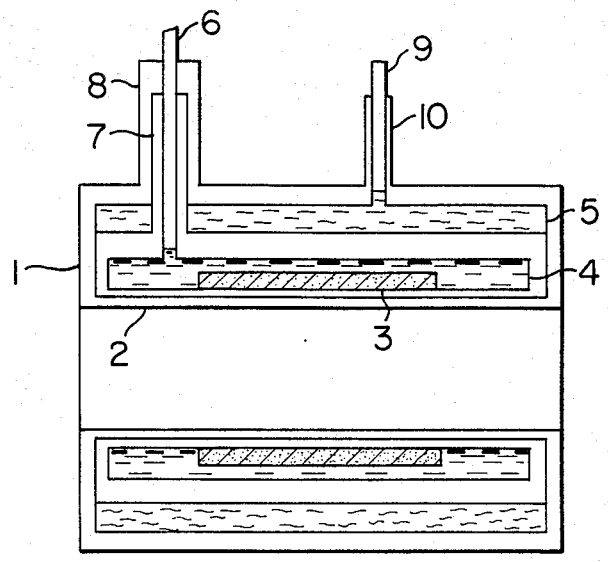
FIG. 1 PRIOR ART
FIG. 1 is a longitudinal sectional view showing a conventional cryostat for cooling a superconductive magnet.
Figure 2:
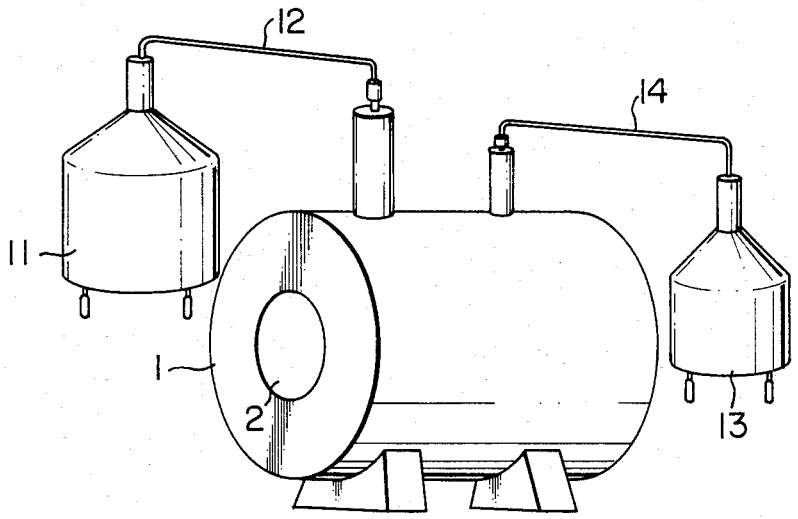
FIG. 2 PRIOR ART
FIG. 2 is an illustration of the conventional cryostat in use.
Figure 3:
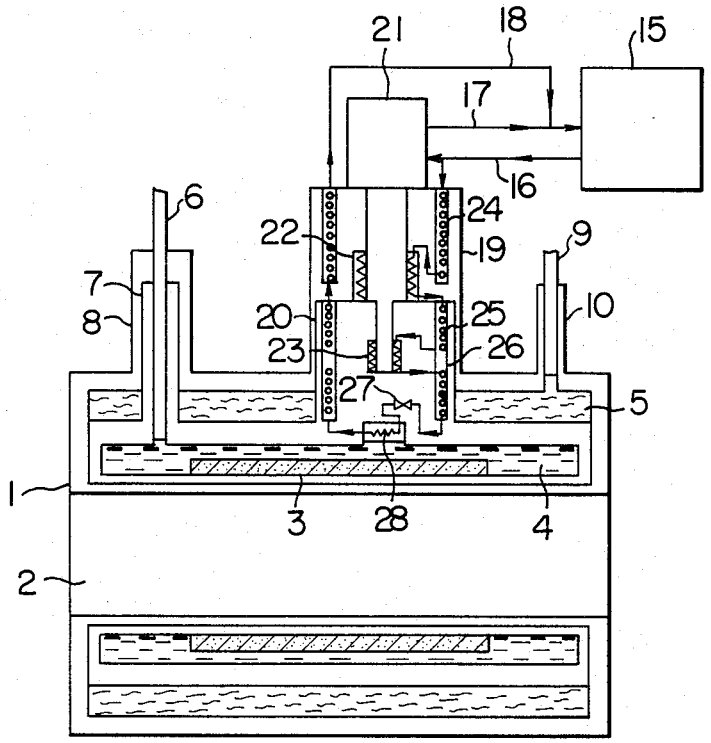
FIG. 3 is a longitudinal sectional view showing an embodiment of a cryostat with a refrigerating machine according to the present invention.
Figure 4:
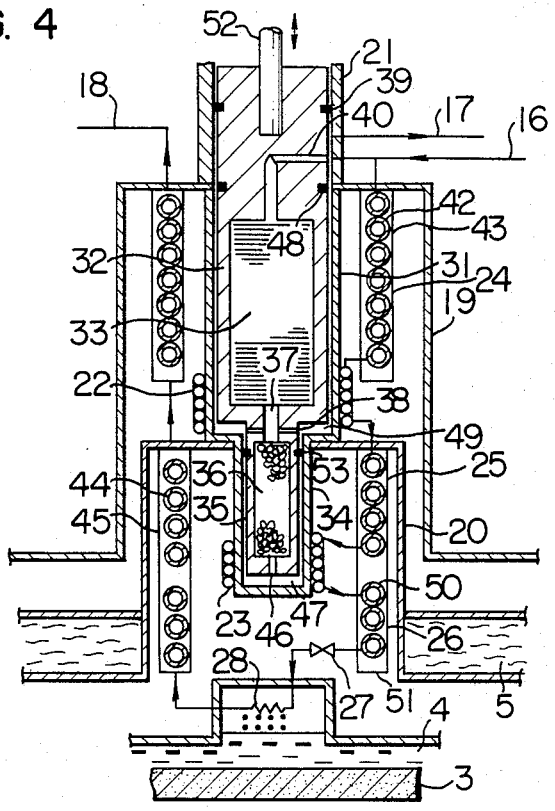
FIG. 4 is a partial enlarged view of the cryostat shown in FIG. 3.

One embodiment of the invention will now be described with reference to FIGS. 3 and 4. In FIGS. 3 and 4, the same reference numerals used in FIG. 1 are used to indicate the like components and members, and explanations therefor are dispensed with.

Reference numeral 15 denotes a helium compressor for supplying a high pressure helium gas; 19, an outer mounting base in which a space is formed by extending an outer wall of the cryostat body 1; 20, an inner mounting base which is formed by projecting a part of the liquefied nitrogen reservoir 5 into the outer mounting base 19; and 21, a two-stage expansion type refrigerating machine for generating a low temperature state by the action of expansion of the high pressure helium gas. The two-stage expansion type refrigerating machine will be hereinafter referred to simply as the refrigerating machine. A first cylinder 31 and a second cylinder 34 are arranged in the outer mounting base 19 and the inner mounting base 20, respectively. A cold end of the first cylinder 31 is mounted in thermal contact with the inner mounting base 20. Reference numeral 22 denotes a first cold station composed of a heat exchanger provided on the outside of the cold end of the first cylinder 31; 23, a second cold station composed of a heat exchanger provided on the outside of a cold end of the second cylinder 34; and 24, a first heat exchanger composed of a cylindrical first shell 43 in which a fin tube 42 is provided. The first heat exchanger is mounted in an inner wall of the outer mounting base 19 so as to surround the first cylinder 31. Reference numerals 25 and 26 denote second and third heat exchangers, respectively, composed of second and third cylindrical shells 45 and 51 which are integrally formed with each other and are provided therewithin with fin tubes 44 and 50. The second and third heat exchangers are mounted on an inner wall of the inner mounting base 20 so as to surround the second cylinder 34. One end of the fin tube 42 within the first heat exchanger 24 is connected to a high pressure helium gas supply pipe 16. The other end of the fin tube 42 and one end of the fin tube 44 of the second heat exchanger 25 are connected through the first cold station 22. The other end of the fin tube 44 within the second heat exchanger 25 and one of the fin tube 50 of the third heat exchanger 26 are connected through the second cold station 23. The other end of the fin tube 50 is connected through a Joule-Thomson valve 27 to one end of a condensing heat exchanger 28 provided in the liquefied helium reservoir 4. The other end of the condensing heat exchanger 28 is connected to one end of the third shell 51 of the third heat exchanger 26. One end of the second shell 45 of the second heat exchanger 25 formed integrally with the third shell 51 is connected to one end of the first shell 43 of the first heat exchanger 24. The other end of the first shell 43 is connected to a return pipe 18. Reference numeral 32 denotes a first displacer encasing therein a first regenerator 33 (for example, formed of copper meshes having a large heat capacity) and having a first expansion chamber 49. The first displacer is displaceably inserted into the first cylinder 31 and is reciprocatingly driven through a rod 52. Reference numeral 35 denotes a second displacer formed integrally with or through pin-coupling with the first displacer 32. The second displacer encases therein a second regenerator (for example, having a larger capacity and using a lead ball in order to increase its filling density exceeding that of the first regenerator). The second displacer is displaceably inserted into the second cylinder 34 and is provided therein with a second expansion chamber 47. Reference numeral 37 denotes an intermediate passage for allowing the interiors of the first displacer 32 and second displacer 35 to communicate with each other. Reference numeral 38 denotes first gas supply ports for allowing the intermediate passage 37 and the first expansion chamber 49; 46, a second gas supply port for allowing the interior of the second displacer 35 and the second expansion chamber 47 to communicate with each other; and 40, a gas passage communicating with the first regenerator 33 through the outer circumference of the first displacer 32. Reference numerals 39 and 48 denote seal rings provided on the circumference of the first displacer. The seal ring 39 serves to prevent the helium gas from leaking to the outside. The seal ring 48 serves to prevent the helium gas, kept at a room temperature, from entering into the first expansion chamber 49, kept at a low temperature, past a gap between the first cylinder 31 and the first displacer 32. Reference numeral 53 denotes a seal ring provided on the circumference of the second displacer 35. The seal ring 53 serves to prevent the helium gas, which is kept at a low temperature in the first expansion chamber 49, from entering into the second expansion chamber 47, which is kept at a lower temperature, past a gap between the second cylinder 34 and the second displacer 35.

The high-temperature and high-pressure helium gas which is pressurized by the helium compressor 15 is fed through the high pressure helium gas supply pipe 16 partly to the fin tube 42 which is a high pressure flow passage of the first heat exchanger 24 whereas the remainer thereof is fed to the refrigerating machine 21. The high pressure helium gas fed into the refrigerating machine 21 is made to pass through the gas passage flow 40, the first regenerator 33 within the first displacer 32, the intermediate passage 37 and the first gas supply ports 38 to the first expansion chamber 49 where the high pressure helium gas is adiabatically expanded to become a low-temperature and low-pressure gas. The low-temperature and low-pressure gas serves to cool the end portion of the first cylinder 31 and to cool at the first cold station 22 the high-pressure helium gas which has passed through the first heat exchanger 24. On the other hand, the remainder of the high pressure helium gas which has passed through the intermediate passage 37 is fed through the second gas supply port 46 into the second expansion chamber 47 from the second regenerator 36 in the second displacer 35. In the second expansion chamber 47, the helium gas is adiabatically expanded to become lower temperature and lower pressure gas to thereby cool the end portion of the second cylinder 34 and to thereby cool at the second cold station the high pressure helium gas which has passed through the fin tube 44 which is a high pressure gas flow passage of the first cold station and the second heat exchanger 25. When the first displacer 32 and the second displacer 35 are elevated, the low-temperature and low-pressure helium gases which have been adiabatically expanded in the first expansion chamber 49 and the second expansion chamber 47 are returned back to the helium compressor 15 through the gas flow passage 40 and the return pipe 17 while cooling the second regenerator 36 and the first regenerator 33 and passing therethrough, respectively.

On the other hand, the high pressure helium gas which is cooled in the second cold station 23 passes through the fin tube 50 which is the high pressure gas flow passage of the third heat exchanger 26 and is further cooled by the low pressure gas within the third shell 51 to become lower in temperature. The helium gas is expanded at the Joule-Thomson valve 27 and becomes liquefied state gas of low pressure and low temperature so that the helium gasified by the heat leak from the outside in the liqufied helium reservoir 4 upon passage through the condensing heat exchanger 28 is again condensed and liquefied and returned back to the liquefied helium. As a result, the pressure in the liquefied helium reservoir and a level of the liquefied helium are maintained constant and the exposure of the superconductive magnet 3 is prevented. The low pressure helium gas which has passed through the condensing heat exchanger 28 is allowed to enter into the third shell 51 which is the low pressure gas flow passage of the condensing heat exchanger 26 to thereby cool the high pressure helium gas within the fin tube 50 while increasing its temperature and to enter into the second shell 45 which is the low pressure flow passage of the second heat exchanger 25 to thereby cool the high pressure helium gas within the fin tube 44 while further increasing its temperature. The helium gas is allowed to enter into the first shell 43 which is the low pressure gas flow passage of the first heat exchanger 24 to thereby cool the high pressure helium gas within the fin tube 42 and is returned back to the helium compressor 15 through the return pipe 18.

In the foregoing embodiment;

(1) It is possible to prevent a heat radiation invasion into the first cylinder 31 by arranging the first cylinder 31 and the first cold station 22 inside the cylindrical first heat exchanger 24;

(2) It is possible to prevent a radiation heat leak into the second cylinder 34 by arranging the second cylinder 34 and the second cold station 23 inside the cylindrical second heat exchanger 25 and third heat exchanger 26; and (3) It is possible to cool the liquefied nitrogen reservoir 5 at the first cold station and to prevent an evaporation of the liquefied nitrogen within the liquefied nitrogen reservoir 5 by mounting the end of the first cylinder 31 in thermal contact with the inner mounting base 20 which is formed by extending the liquefied nitrogen reservoir 5.

As has been described above, according to the embodiment of the invention, the evaporation of the liquefied nitrogen may be prevented by the low temperature helium generated from the helium refrigerating machine, and at the same time, the evaporated liquefied helium may be recondensed so that the cryostat may be used continuously for a long period of time without periodically supplying the liquefied nitrogen and helium.

Figure 5:
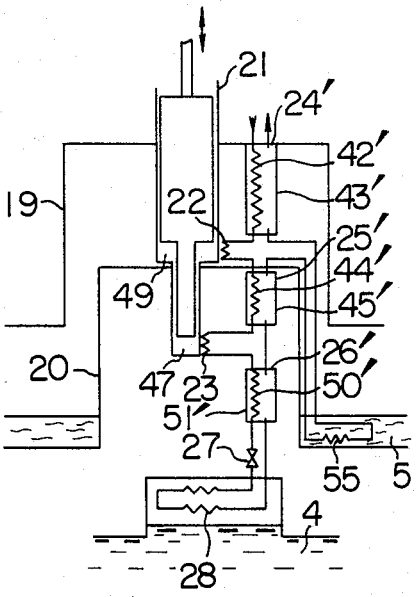
FIG. 5 is a longitudinal sectional view showing an embodiment of a cryostat with a refrigerating machine according to the present invention.

Another embodiment of the invention will now be described with reference to FIG. 5. In FIG. 5, the same reference numerals used in FIGS. 3 and 4 are used to indicate the like components and members. Reference numerals 24', 25' and 26' denote counter flow type heat exchangers having high pressure gas flow passages 42', 44' and 50' and low pressure gas flow passages 43', 45' and 51', respectively. The heat exchangers 24' 25' and 26' are, respectively, first, second and third heat exchangers each composed of a plate fin heat exchanger or a compact type heat exchanger. FIG. 5 schematically shows these heat exchangers which are used as in the refrigerating machine. Reference numeral 55 denotes a condensing heat exchanger provided in a liquefied nitrogen reservoir 5. A low pressure return gas from the second heat exchanger 25' is fed to the condensing heat exchanger to thereby positively cool the liquefied nitrogen reservoir 5 whereby a cooling efficiency of the liquefied nitrogen reservoir 5 may be enhanced and at the same time, the cooling operation may be freely performed without a limitation of the arrangement of the first, second and third heat exchangers, 24', 25' and 26'.

According to this embodiment, since there is no limitation to the arrangement of the first, second and third heat exchangers 24', 25' and 26', it is possible to simplify the piping arrangement therefor.

As has been described above, according to the present invention, in a cryostat composed of the first liquefied gas reservoir containing therein a first liquefied gas, the second liquefied gas reservoir containing therein a second liquefied gas, which has a boiling point higher than that of the first liquefied gas, the second liquefied gas reservoir being provided around the first liquefied reservoir in order to reduce the heat leak into the first liquefied gas reservoir, and an outer wall surrounding the second liquefied gas reservoir through a vacuum space, since a refrigerating machine composed of a heat exchanger and an expansion device for generating a low temperature state is arranged in the space within the outer wall and the refrigerating machine cools the second liquefied gas in the second liquefied gas reservoir and in the first liquefied gas reservoir and the first liquefied gas, an evaporation of the second liquefied gas within the second liquefied gas reservoir may be prevented, the first liquefied gas gasified within the first liquefied gas reservoir may be again condensed, and the cryostat may be used continuously for a long period of time without periodically supplying the second and first liquefied gases.

What is claimed is:

1. A cryostat with a refrigerating machine, comprising a first liquefied gas reservoir containing therein a first liquefied gas, a second liquefied gas reservoir containing therein a second liquefied gas, said second liquefied gas having a boiling point higher than that of the first liquiefied gas and said second liquefied gas reservoir being provided around the first liquefied gas reservoir, an outer wall adapted to surround the second liquefied gas reservoir through a vacuum space, said refrigerating machine including a heat exchanger and an expansion device and having a first section which is kept at a temperature higher that that of said second liquiefied gas reservoir, said first section being provided between the second liquefied gas reservoir and said outer wall; said refrigerating machine having a second section which is kept at a temperature lower than that of said second liquefied gas reservoir, said second section being provided between said first liquefied gas reservoir and said second liquefied gas reservoir, and said cryostat further comprising at least one condenser heat exchanger for recondensing the evaporated gas with a cooled coolant generated in the refrigerating machine, said at least one heat exchanger being provided at least in said first liquefied gas reservoir, and thermal contact means in contact with the refrigerating machine for cooling the second liquefied gas reservoir.

2. A cryostat as claimed in claim 1, wherein said at least one condensing heat exchanger includes a condensing heat exchanger disposed within the second liquefied gas reservoir.

3. A cryostat as claimed in claim 1, wherein said heat exchanger is formed of cylindrical first, second and third heat exchangers, the first heat exchanger being provided in said first section and the second and third heat exchangers being provided in said second section, and the expansion device is of reciprocating type and includes first and second cylinders and first and second cold stations, with the first cylinder and the first cold station of the expansion device being provided inside first heat exchanger, and the second cylinder and the second cold station of the expansion device being provided inside of said second and third heat exchangers.

4. A cryostat as claimed in claim 3, wherein the first cold station is connected between the first heat exchanger and the second heat exchanger, the second cold station is connected between the second heat exchanger and the third heat exchanger, and the condensing heat exchanger provided in the first liquefied gas reservoir is connected to a low temperature end of the third heat exchanger.

5. A cryostat as claimed in claim 1, wherein a first stage expander and a first heat exchanger of said refrigerating machine are disposed between said second liquefied gas reservoir and said outer wall, and a second stage expander, a second heat exchanger and a third heat exchanger are disposed between said first liquefied gas reservoir and said second liquefied gas reservoir.

6. A cryostat with a refrigerating machine, comprising a first liquefied gas reservoir containing therein a first liquefied gas, a second liquefied gas reservoir containing therein a second liquefied gas, said second liquefied gas having a boiling point higher than that of the first liquefied gas and said second liquefied gas reservoir being provided around the first liquefied gas reservoir, an outer wall adapted to surround the second liquefied gas reservoir through a vacuum space, said refrigerating machine including a first heat exchanger, a second heat exchanger and a third heat exchanger and a two-stage expansion device composed of a first stage expander and a second stage expander, wherein said first stage expander and said first heat exchanger of said refrigerating machine are disposed between said second liquefied gas reservoir and said outer wall, said second stage expander, said second heat exchanger and said third heat exchanger are disposed between and first liquefied gas reservoir and said second liquefied gas reservoir, a first stage cold station and a second stage cold station are provided at lower temperature sides of said first stage expander and said second stage expander, respectively, with said first stage cold station being connected between said first heat exchanger and said second heat exchanger and said second stage cold station being connected between said second heat exchanger and said third heat exchanger, the lower temperature side of said third heat exchanger being connected through a tubing to a condenser heat exchanger within said first liquefied gas reservoir, and a tubing between said first heat exchanger and said second heat exchanger being connected to said condenser heat exchanger.

7. A cryostat as claimed in claim 6, wherein said first heat exchanger, said second heat exchanger and said third heat exchanger are in the form of cylinders, said first stage expander and said first stage cold station are arranged insider of said first heat exchanger, and said second stage expander and said second stage cold station are arranged insider of said second heat exchanger and said third heat exchanger.

8. A cryostat with a refrigerating machine, comprising a first liquefied gas reservoir containing therein a first liquefied gas, a second liquefied gas reservoir containing therein a second liquefied gas, said second liquefied gas having a boiling point higher that that of the first liquefied gas and said second liquefied gas reservoir being provided around the first liquefied gas reservoir, an outer wall adapted to surround the second liquefied gas reservoir through a vacuum space, and wherein said refrigerating machine is a two-stage expansion type refrigerating machine including a heat exchanger and an expansion device, wherein a first stage expander and a first heat exchanger of said refrigerating machine are disposed between said second liquefied gas reservoir and said outer wall, a second stage expander, a second heat exchanger and a third heat exchanger are disposed between said first liquefied gas reservoir and said second liquefied gas reservoir, a lower temperature end of said first stage expander and said second liquefied gas reservoir are thermally coupled to each other, and a condenser heat exchanger for recondensing the evaporated gas with a cooled coolant generated in said refrigerating machine is provided in said first liquefied gas reservoir.

9. A cryostat as claimed in claim 8, wherein said first stage expander and said first heat exchanger; and said second stage expander, said second heat exchanger and said third heat exchanger; are disposed in a space defined between an inner mounting plate and an outer mounting plate from which said outer wall and a part of said second liquefied gas reservoir extend outwardly, and a space within said inner mounting plate, respectively, and said lower temperature end of said first stage expander and said inner mounting plate are thermally coupled to each other.

* * * * *